US005621196A

United States Patent [19]

Nishijima et al.

[11] Patent Number: 5,621,196

[45] Date of Patent: Apr. 15, 1997

[54] ROTARY OPERATION SWITCH AND MULTIDIRECTION INPUT APPARATUS

[75] Inventors: Akio Nishijima; Takashi Asagawa, both of Fukushima-ken, Japan

[73] Assignee: Alps Electric Co., Ltd., Tokyo, Japan

[21] Appl. No.: 515,079

[22] Filed: Aug. 14, 1995

[30] Foreign Application Priority Data

Aug. 26, 1994 [JP] Japan ..... 6-202159

[51] Int. Cl.[6] ..... H01H 25/04

[52] U.S. Cl. ..... 200/6 A; 200/4; 200/5 R

[58] Field of Search ..... 200/4, 5 R, 5 A, 200/11 R, 11 A, 11 D, 11 DA, 11 E, 11 K, 6 R, 6 A, 16 R, 16 A, 16 D, 17 R, 18

[56] References Cited

U.S. PATENT DOCUMENTS

| | | | |
|---|---|---|---|
| 4,611,102 | 9/1986 | Ishida | 200/5 R |
| 5,430,261 | 7/1995 | Malone | 200/1 B |
| 5,496,977 | 3/1996 | Date et al. | 200/6 A |
| 5,498,843 | 3/1996 | Date et al. | 200/6 A |

FOREIGN PATENT DOCUMENTS

| | | | |
|---|---|---|---|
| 6-150778 | 5/1994 | Japan | H01H 25/04 |

*Primary Examiner*—Michael L. Gellner
*Assistant Examiner*—Michael A. Friedhofer
*Attorney, Agent, or Firm*—Guy W. Shoup; Patrick T. Bever

[57] ABSTRACT

A multidirection input apparatus including a housing, a driving member movably positioned within the housing, and an operation member fixedly attached to the driving member and extending from the housing for manual manipulation. The driving body is supported by an elastic member over an input switch. The elastic member includes six protrusions (two rotation protrusions and four tilt protrusions), each protrusion having a movable contact formed on a lower surface of the elastic member, and each movable contact is positioned over an associated fixed contact located on a lower substrate of the housing. Manual rotation of the operation member causes rotation of the driving member which, in turn, presses against one of the two rotation protrusions, thereby causing the movable contact associated with the rotation protrusion to contact its associated fixed contact on the lower substrate. Manual tilting of the operation member causes tilting of the driving member which, in turn, presses against one or more of the tilt protrusions, thereby causing the movable contacts associated with the tilt protrusions to contact their associated fixed contact on the lower substrate. Downward pressure on the operation member causes the driving member to actuate the input switch.

4 Claims, 6 Drawing Sheets

ROTARY OPERATION SWITCH AND MULTIDIRECTION INPUT APPARATUS

BACKGROUND OF THE INVENTION

1. Field of the Invention

The present invention relates to a rotary operation switch which allows the contact thereof to be changed over through rotation of its operation body and also relates to a multidirection input apparatus wherein a variety of contacts thereof are switched through rotation or tilting of its operation body.

2. Description of the Prior Art

An example of the conventional multidirection input apparatus is disclosed in Japanese Patent Application Laid-open No. 6-150778. As described therein, a driving body is held in a housing in such a way that the driving body can be rotated and tilted. In addition, a plurality of tact switches which can be driven by the driving body are arranged in the housing. The tact switches are mounted on an insulating substrate by soldering them thereto. The tact switches used are of the horizontal and vertical types with a stem thereof oriented in the horizontal and vertical direction respectively. In the case of the horizontal type, two tact switches are arranged through portions protruding out off the circumference edge of the driving body. In the case of the vertical type, on the other hand, four tact switches are laid out beneath the driving body, being separated from each other by an angle of 90 degrees.

In the multidirection input apparatus having such a configuration, rotating an operation body, which is joined to the driving body, in the normal or reserved direction puts a pressure on any one of the horizontal-type tact switches against the protruding portion of the driving body, turning the tact switch on. Tilting the operation body in any arbitrary direction, on the other hand, selectively puts a pressure on a vertical-type tact switch which is placed in the tilting direction, turning the tact switch on. In this way, the switching operation can be accomplished not only by a tilting operation but also by a rotating operation.

In the case of the conventional multidirection input apparatus described above, however, since the horizontal-type tact switches are each used as a switch device which is actuated by the rotation of the driving body, no overstroke is resulted in after the switch has been turned on. As a result, for the operator operating the operation body, a problem of poor operation feeling exists. Such a problem is encountered not only in a multidirection input apparatus, but also in a rotary operation switch in general wherein a tact switch is actuated by rotating an operation body.

In addition, in the conventional multidirection input apparatus described above, it is necessary to mount a plurality of tact switches on an insulating substrate by soldering them thereto. On the top of that, since the horizontal-type tact switch has a large thickness (height dimension) in comparison with the vertical-type tact switch, the number of components and the number of assembly operations are increased, giving rise to a problem that it is difficult to design a thin version of the apparatus.

The present invention addresses the problems encountered in the state of the conventional technology described above. It is a first object of the present invention to provide a rotary operation switch that provides the operator with good operation feeling. It is a second object of the present invention to provide a multidirection input apparatus which readily allows the number of components and the number of assembly operations to be reduced and allows a thin version thereof to be designed.

In addition, in the case of the conventional multidirection input apparatus described above, the driving body is held in the housing by a plurality of pieces of elastic material provided on the driving body. The pieces of elastic material increase the size of the multidirection input apparatus. In order to solve this problem, a multidirection input apparatus wherein the driving body is held in the housing by utilizing an elastic force produced by each tact switch for detecting a tilt, have been proposed. In this case, however, when a tact switch for detecting a vertical movement is turned on by pressing the center of the operation body, each tact switch for detecting a tilt is also pressed by the downward movement of the operation body. As a result, a click feeling originated by the tact switch for detecting a vertical movement is inevitably weakened, giving rise to a problem that, for the operator pressing the operation body, the operation feeling is poor.

As mentioned earlier, the present invention addresses the problems encountered in the state of the conventional technology described above. To be more specific, it is another object of the present invention to provide a multidirection input apparatus that offers clear click feeling as well as good operation feeling.

SUMMARY OF THE INVENTION

In order to achieve the first object of the present invention, the present invention provides a rotary operation switch comprising: a driving body held in a housing in such a way that the driving body can be rotated; a switch device embedded in the housing; and an insulating substrate for mounting the switch device, wherein the switch device is actuated by rotating the driving body. In the rotary operation switch, a fixed contact point for the switch device is provided on the insulating substrate, a movable contact point for the switch device is provided on the lower surface of an elastic substrate mounted above the insulating substrate, a protrusion is provided on the upper surface of the elastic substrate, protruding into a rotation area of the driving body, and the movable contact point is placed at an eccentric position relative to the center of the protrusion.

In order to achieve the second object of the present invention, the present invention provides a multidirection input apparatus comprising: a driving body held in a housing in such a way that the driving body can be rotated and tilted in a number of directions; a switch device for detecting a rotation and a plurality of switch devices each for detecting a tilt which switch devices are embedded in the housing; and an insulating substrate for mounting the switch devices, wherein the switch device for detecting a rotation is actuated by rotating the driving body and the switch devices each for detecting a tilt are selectively actuated by tilting the driving body in any arbitrary direction, In the multidirection input apparatus, a fixed contact point for each of the switch device for detecting a rotation and the switch devices each for detecting a tilt is provided on the insulating substrate, an elastic substrate having first and second protrusions is mounted above the insulating substrate, the first protrusion protrudes into a rotation area of the driving body, a movable contact point of the switch device for detecting a rotation is provided on the inner bottom surface of the first protrusion at an eccentric position relative to the center thereof, the second protrusion is exposed to the lower surface of the driving body, and movable contact points for the switch devices each for detecting a tilt are each provided on the inner bottom surface of any one of the second protrusions.

In order to achieve the third object of the present invention, the present invention provides a multidirection input apparatus comprising: a switch device for detecting a vertical movement and a plurality of switch devices each for detecting a tilt; an insulating substrate for mounting the switch devices; and a driving body held by the switch devices each for detecting a tilt in such a way that the driving body can be moved up and down as well as tilted, wherein the switch device for detecting a vertical movement is actuated, providing a click feeling to the operator when the operator puts a pressure on the center of the driving body and the switch devices each for detecting a tilt are selectively actuated by tilting the driving body in any arbitrary direction, In the multidirection input apparatus, a fixed contact point for each of the switch devices for detecting a tilt is provided on the insulating substrate, an elastic substrate is mounted above the insulating substrate, a middle portion extended above the insulating substrate through an outer thin pad is provided on the elastic substrate, a plurality of protrusions each protruding from the middle portion in a slanting upward direction through an inner thin pad are provided on the elastic substrate, and a movable contact point for each of the switch devices for detecting a rotation is provided on the inner bottom surface of any one of the protrusions.

When the driving body is rotated in the normal or reserved direction, a side surface of a first protrusion provided on the elastic substrate is pressed by the driving body. Pressed by the driving body, the protrusion tilts toward the opposite side with the pressed side serving as a fulcrum. As a result, a movable contact point provided on the inner bottom surface of the protrusion is brought into contact with a fixed contact point provided on the insulating substrate, causing the switch device for detecting a rotation to turn on. Here, since the movable contact point is provided at an eccentric position relative to the center of the protrusion, the movable contact point is brought into contact with the fixed contact point even for a small amount of protrusion tilting. On the top of that, even after the movable contact point has been brought into contact with the fixed contact point, the protrusion changes its shape elastically, generating an overstroke. In addition, as the force rotating the driving body is removed, the protrusion is returned to a posture prior to the tilting by virtue of an elastic force of its own, moving the movable contact point away from the fixed contact point. As a result, the switch device is restored to the previous off state.

When the driving body is tilted in any arbitrary direction, on the other hand, the ceiling surface of a second protrusion located in the tilting direction is pressed by the driving body, causing the second protrusion to be deformed. As a result, a movable contact point provided on the inner bottom surface of the second protrusion is brought into contact with a fixed contact point provided on the insulating substrate, causing a switch device for detecting the tilt to turn on. In addition, as the force tilting the driving body is removed, the second protrusion is returned to a posture prior to the deformation by virtue of an elastic force of its own, moving the movable contact point away from the fixed contact point. As a result, the switch device is restored to the previous off state.

In addition, when the driving body is tilted in any arbitrary direction, the ceiling surface of a protrusion located in the tilting direction is pressed by the driving body, causing first of all the outer thin pad of the second protrusion to be deformed and the middle portion to come into contact with the insulating substrate. Thereafter, as the inner thin pad is also deformed, a movable contact point provided on the inner bottom surface of the protrusion is brought into contact with a fixed contact point provided on insulating substrate, causing a switch device for detecting the tilt in the tilting direction to turn on. At that time, other switch devices for detecting a tilt and the switch device for detecting a vertical movement do not experience a pressure form the driving body, sustaining their off state.

When the center of the driving body is pressed, on the other hand, the driving body moves down against the resistance by an elastic force of each protrusion. As a result, the switch device for detecting a vertical movement is pressed by the driving body and put in an on state. At that time, each protrusion also experiences the pressing force applied by the driving body, changing its shape till the middle portion is brought into contact with the insulating substrate. However, it is only the outer thin pad that is deformed. The inner thin pad which requires a relatively large pressing force is not deformed. As a result, the click feeling originated from the switch device for detecting a vertical movement is all but hardly reduced due to the deformation of the protrusions.

DESCRIPTION OF THE PREFERRED EMBODIMENTS

The present invention will become apparent from the following detailed description of preferred embodiments with reference to accompanying diagrams.

Figure 3:
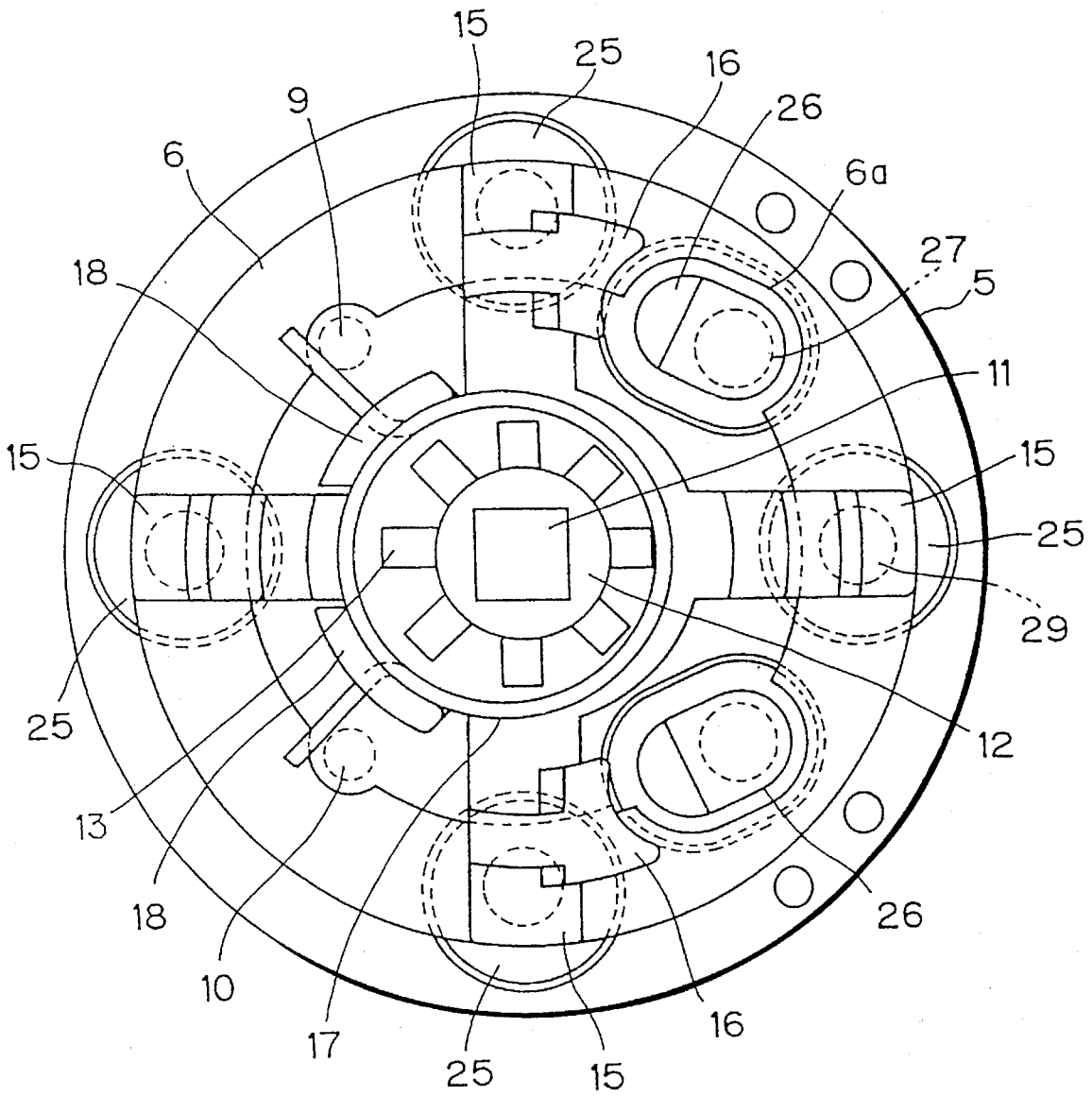
FIG. 3 is a planar diagram showing principal components of the multidirection input apparatus.
Figure 4:
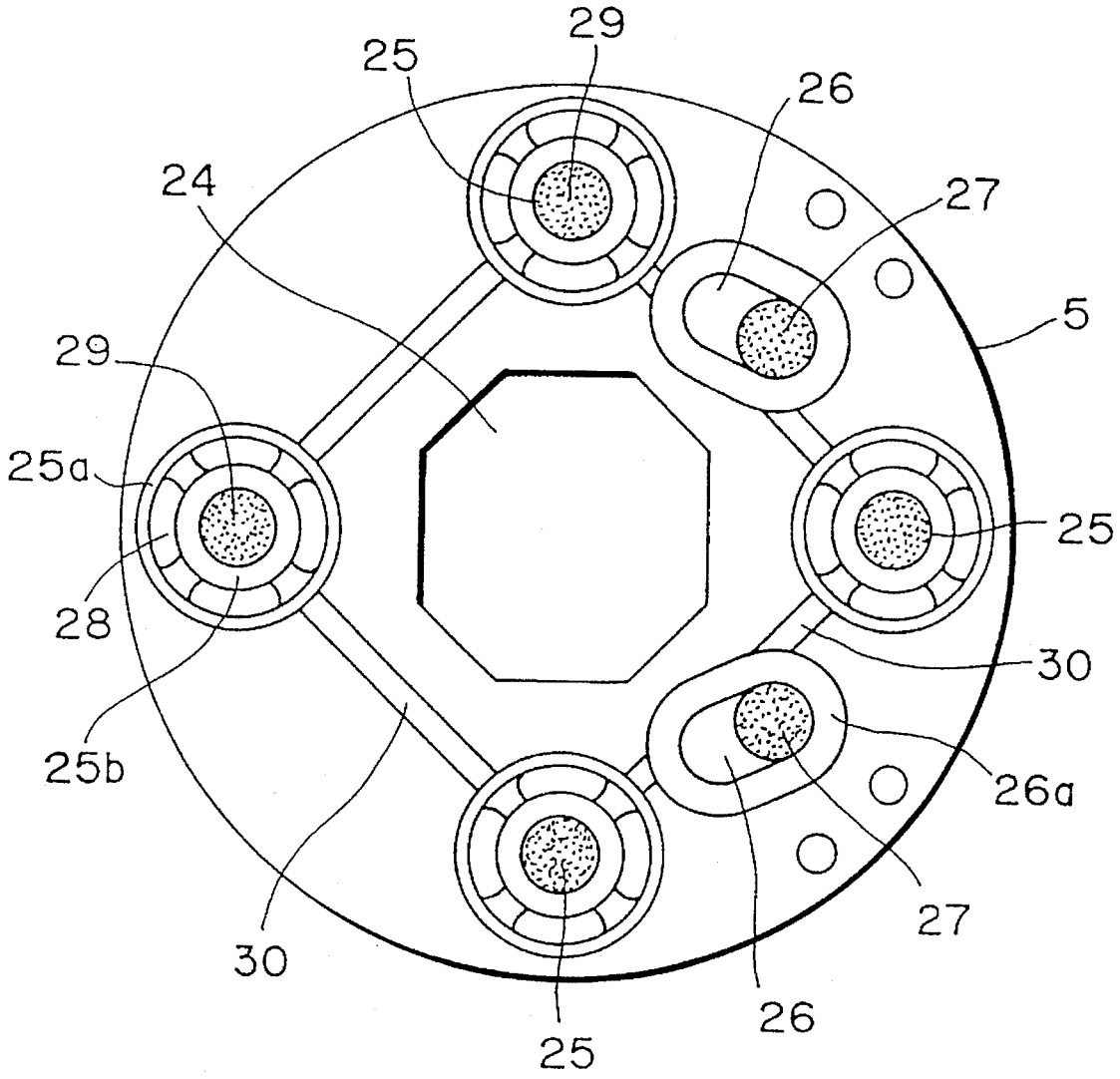
FIG. 4 is a diagram showing the back surface of an elastic substrate employed in the multidirection input apparatus.

A multidirection input apparatus implemented by the embodiment mainly comprises a housing 1 serving as an outer shell, a driving body 2 installed in the housing 1, an operation body 3 outside the housing 1 which operation body 3 constitutes a single assembly in conjunction with the driving body 2, an insulating substrate 4 fixed at the lower end of the housing 1, an elastic substrate 5 mounted on the insulating substrate 4, and a slippery ring 6 installed between the driving body 2 and the elastic substrate 5. The housing 1 is made of a compound resin material. A through hole 7 is drilled through the center of the ceiling surface of the housing 1. A guide *7a* is formed inside the through hole 7. Four openings 8 are provided around the through hole 7. In addition, two pins 9 and 10 shown in FIG. 3 are erected on the ceiling surface of the housing 1.

The driving body 2 is made of a compound resin material. An axis 12 having a cornered hole 11 is provided at the center of the driving body 2. A plurality of wings 13 provided around the the axis 12 form a single assembly. The upper portion of each wing 13 forms a bent surface 13*a*, a portion of a spherical surface with the center thereof coinciding with a fulcrum O shown in FIG. 1. A half-spherical pressing unit 14 on the lower surface of the axis 12 constitutes a single assembly in conjunction with four arms 15 extending from the lower portion of the axis 12 to form a radial shape. The four arms 15 are arranged at locations separated from each other by a 90-degree segment. Pressing units 16 are formed on opposing two of the four arms 15 which opposing two are separated from each other by a 180-degree segment. A torsion spring 17 is wound around the lower portion of each wing 13. Both the ends of the torsion spring 17 are attached to a spring bearing unit 18 provided on the driving body 2 and located between the pins 9 and 10 of the housing 1. Part of the axis 12 is further extended to the outside of the housing 1 through the through hole 7. An axis 19 is provided vertically at the center of the operation body 3. By inserting the axis 19 into the cornered hole 11, the driving body 2 and the operation body 3 are joined to each other to form a single assembly.

Figure 5:
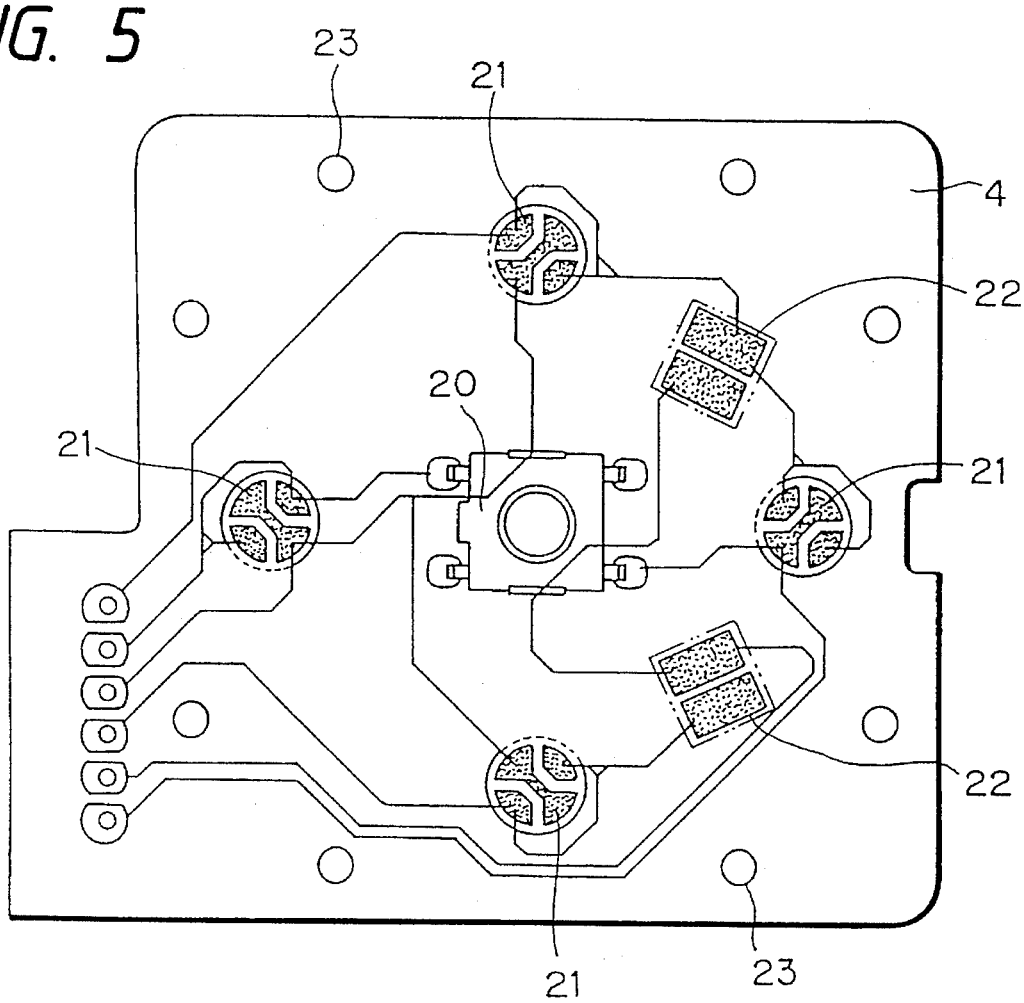
FIG. 5 is a planar diagram showing an insulating substrate employed in the multidirection input apparatus.

The insulating substrate 4 is made of an insulating material such as phenol resin. A horizontal-type tact switch 20 is soldered to the center of the insulating substrate 4. The tact switch 20 is a widely used product wherein, by pressing a stem protruding from its upper end, a click feeling is provided at the time the contact thereof is switched. As shown in FIG. 5, four fixed contact points 21 are created on the insulating substrate 4 around the tact switch 20 at locations separated from each other in the circular direction by an angle of 90 degrees. In addition, two fixed contact points 22 are created at locations between adjacent three of the four fixed contact points 21. Furthermore, a plurality of installation holes 23 are provided on the insulating substrate 4. By inserting protruding pins provided on the bottom of the housing 1 into the installation holes 23 and, if necessary, by fixing the pins to the holes 23 through heating, the housing 1 can be joined to the insulating substrate 4 to form a single assembly. It should be noted that the protruding pins themselves are not shown in the figure.

Figure 1:
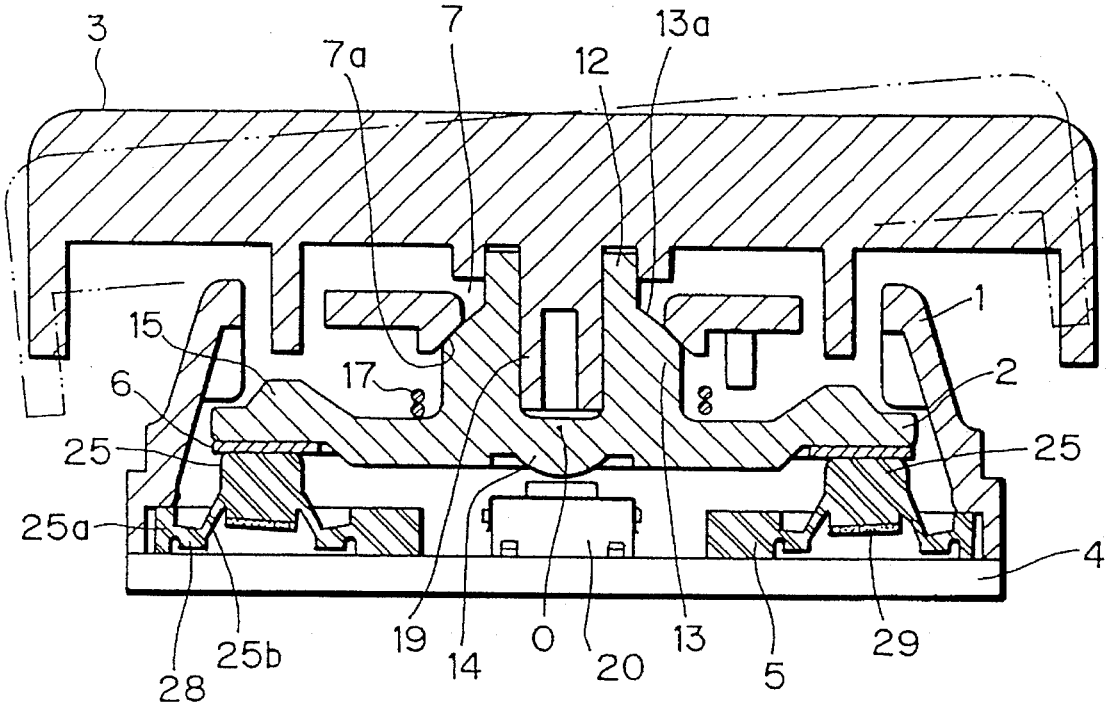
FIG. 1 is a cross sectional diagram of an embodiment implementing a multidirection input apparatus in accordance with the present invention.
Figure 2:
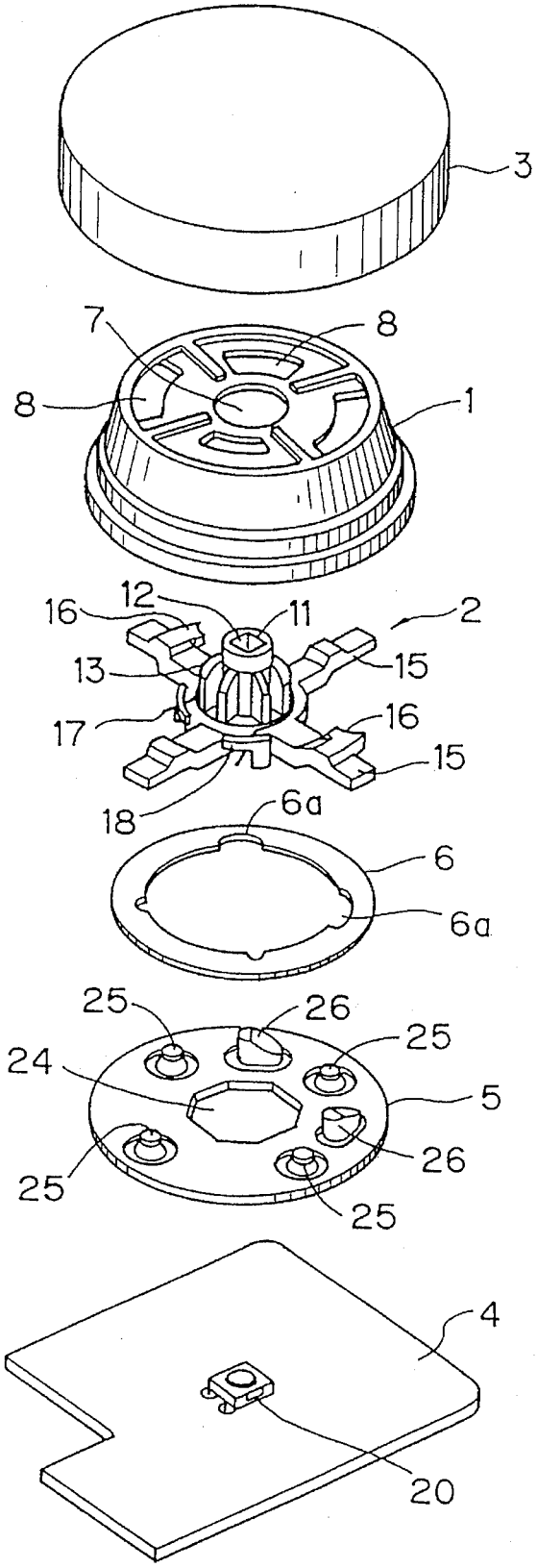
FIG. 2 is a diagram showing an analytical squint view of the multidirection input apparatus.
Figure 6:
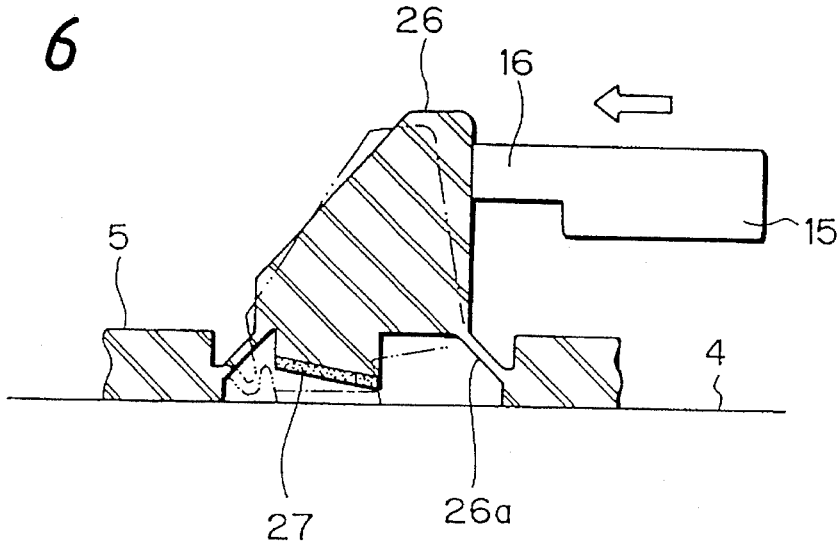
FIG. 6 is an explanatory diagram used for explaining the operation of a first protrusion provided in the multidirection input apparatus.
Figure 7:
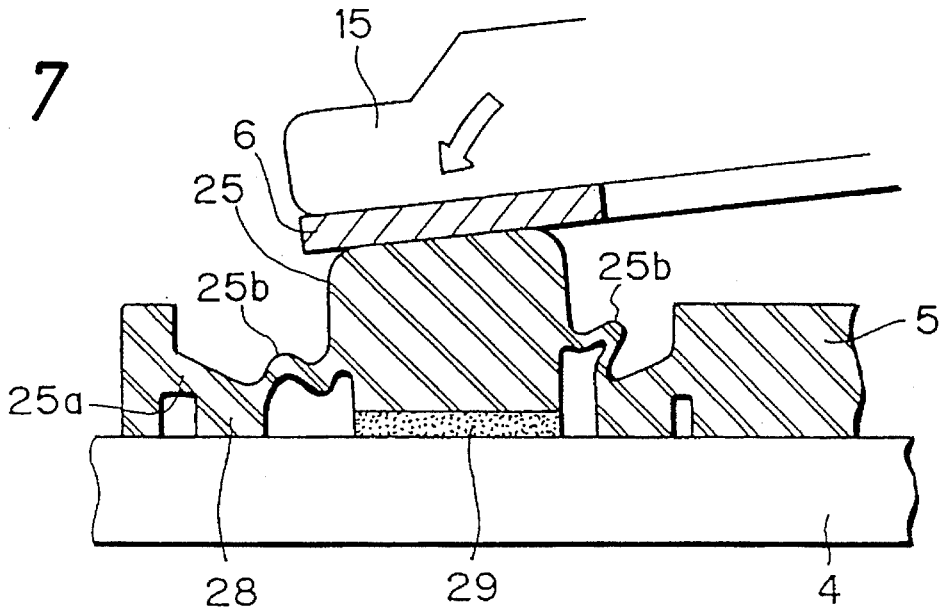
FIG. 7 is an explanatory diagram used for explaining the tilting operation of a second protrusion provided in the multidirection input apparatus.

The elastic substrate 5 is made of an elastic material such as silicon rubber. A window 24 is provided at the center of the elastic substrate 5, which is held by the lower part of the housing 1 and the insulating substrate 4. Four second protrusions 25 are on the upper surface of the elastic substrate 5 around the window 24 at locations separated from each other by 90 degrees in the circular direction. Two first protrusions 26 are formed at locations between adjacent three of the four second protrusions 25. As shown in FIG. 6, the first protrusions 26 each protrude upward from the upper surface of the elastic substrate 5 through a thin pad 26*a* which extends from the upper surface in a slanting/upward direction. The upper portions of the first protrusions 26 are exposed to the side surfaces of the pressing units 16 of the driving body 2. In addition, a movable contact point 27 is provided on the inner bottom surface of each of the first protrusions 26. The movable contact points 27 are each exposed to any one of the fixed contact points 22 on the insulating substrate 4. The fixed contact points 22 and the movable contact points 27 constitute contact mechanisms of rotation detecting switch devices. The movable contact points 27 are each located at an eccentric position relative to the center of the first protrusion 26 associated therewith in a direction that separates the movable contact point 27 from the pressing units 16. On the top of that, separated away from the pressure units 16, the movable contact points 27 are inclined in a direction departing from the insulating substrate 4. As shown in FIG. 1, on the other hand, the second protrusions 25 each protrude upward from the upper surface of the elastic substrate 5 through an outer thin pad 25*a*, a ring-shaped unit 28 extending in the horizontal direction and an inner thin pad 25*b* which extends from the ring-shaped unit 28 in a slanting/upward direction. The ceiling surfaces of the second protrusions 25 are exposed to the lower surfaces of the arms 15 of the driving body 2 through a slippery ring 6 to be discussed later. In addition, a movable contact point 29 is provided on the inner bottom surface of each of the second protrusions 25. The movable contact points 29 are each exposed to any one of the fixed contact points 21 formed on the insulating substrate 4. Exposed to the external side of the elastic substrate 5, the movable contact points 29 are inclined to be separated away from the insulating substrate 4. The fixed contact points 21 and the movable contact points 29 constitute contact mechanisms of tilt detecting switch devices. Furthermore, grooves 30 for exhausting air, which grooves 30 link the first and second protrusions 25 and 26 to each other, are formed on the rear surface of the elastic substrate 5.

The slippery ring 6 cited above is made of a highly slippery material such as PVC and teflon. Two cuts 6*a* are created on the inner circumference edge of the slippery rings 6. The slippery rings 6 are installed between the lower surface of each of the arms 15 on the driving body 2 and the ceiling surface of each of the second protrusions 25 on the elastic substrate 5. Both the first protrusions 26 of the elastic substrate 5 extend to an altitude above the slippery ring 6 through the cuts 6*a*. Here, the positional relation of the driving body 2 and the elastic substrate 5 is set so that the arms 15 each press down the second protrusion 25 associated therewith by a small amount of displacement. As a result, experiencing a reactive force applied by each of the second protrusions 25, the driving body 2 is always pressed upward, being held in a horizontal state inside the housing 1. In addition, by sliding the bent surfaces 13*a* along the guide 7*a*, the driving body 2 can be rotated as well as tilted in a number of directions. On the top of that, the driving body 2 can also be pressed downward, resisting elastic forces of all the second protrusions 25.

The operation of the multidirection input apparatus having such a configuration is described as follows.

FIG. 1 shows the multidirection input apparatus in an inoperative state. In this state, a clearance is formed between the pressing unit 14 of the driving body 2 and the stem of the tact switch 20, putting the tact switch 20 in an off state. In addition, the movable contact points 27 of the first protrusions 26 and the fixed contact points 22 on the insulating substrate 4 are all separated from each other. Likewise, the movable contact points 29 of the second protrusions 25 and the fixed contact points 21 on the insulating substrate 4 are also all separated from each other as well. In this state, the rotation detecting switch devices and the tilt detecting switch devices are turned off. It should be noted that the lower surfaces of the ring-shaped units 28 of the second protrusions 25 are each separated from the surface of the insulating substrate 4 by a small distance which is set at the same amount as the clearance between the pressed pressing unit 14 and the stem of the tact switch 20.

With the multidirection input apparatus put in an inoperative state as shown in FIG. 1, let the operator rotate the operation body 3 in either the normal or reversed direction. For example, the operation body 3 is rotated in, say, the clockwise direction as shown in FIG. 3. In this case, the driving body 2 forming a single assembly in conjunction with the operation body 3 is also rotated in the same direction around an axial line passing through the fulcrum O. At that time, the slippery ring 6 does not rotate over the elastic substrate 5 due to a difference in coefficient of friction between the driving body 2 made of a compound resin material and the elastic substrate 5 made of typically silicon rubber. Instead, the lower surfaces of the arms 15 of the driving body 2 rotate as well as slide over the upper surface of the slippery ring 6. As the driving body 2 is rotated as described above, the torsion spring 17 is contracted due to the fact that one end of the torsion spring 17 is pressed against but stopped by the pin 9. In addition, since one of the two pressing units 16 of the driving body 2 puts a pressure on the first protrusion 26 of the elastic substrate 5 exposed to the corresponding pressing unit 16, the thin pad **26*a* of the first protrusion 26 is deformed, putting the first protrusion 26 in a slanting posture with the pressed side serving as a fulcrum as shown by a double-dotted line in FIG. 6. At that time, a click feeling is produced and transmitted to the operator through the driving body 2 and the operation body 3. As the first protrusion 26 is inclined as described above, the movable contact point 27 provided on the inner bottom surface of the first protrusion 26 is brought into contact with the fixed contact point 22 exposed to the movable contact point 27, causing one of the rotation detecting switch devices to turn on. As described above, even a small amount of inclination of the first protrusion 26 will bring the movable contact point 27 into contact with the fixed contact point 22 because the movable contact point 27 is placed at an eccentric location relative to the center of the first protrusion 26 in the tilting direction away from pressed side. In addition, even after the movable contact point 27 has been brought into contact with the fixed contact point 22, an overstroke is obtained due to the elastic deformation of the first protrusion 26**.

As the force rotating the operation body 3 is removed, the driving body 2 is rotated back and restored to a state shown in FIG. 3 by the force generated by the decontraction of the contracted torsion spring 17 and the first protrusion 26 is also automatically restored to a position indicated by a solid line in FIG. 6 by virtue of the elastic property of the first protrusion 26 itself. At the same time, the movable contact point 27 is separated away from the fixed contact point 22, putting the rotation detecting switch device back to its original off state. It should be noted that, when the operator rotates the operation body 3 in the counterclockwise direction of FIG. 3 as opposed to what has been described so far, the torsion spring 17 is contracted due to the fact that the other end of the torsion spring 17 is pressed against but stopped by the pin 10 and the other first protrusion 26 of the elastic substrate 5 is pressed by the other pressing unit 16 of the driving body 2, causing the other rotation detecting switch device to turn on.

With the multidirection input apparatus put in the inoperative state shown in FIG. 1, let the operator press any arbitrary peripheral of the operation body 3 such as the left/upper end of the operation body 3. At that time, the operation body 3 and the driving body 2 are inclined with the fulcrum 0 serving as a center in a direction indicated by a double-dotted line in the same figure, causing the arm 15 of the driving body 2 shown on the left side of FIG. 1 to put a pressure on the second protrusion 25 placed beneath the arm 15 through the slippery ring 6. At that time, since the first protrusion 26 of the elastic substrate 5 is placed inside the cut **6*a* of the slippery ring 6, no pressing force whatsoever is applied to the first protrusion 26 even if the slippery ring 6 is tilted. As the second protrusion 25 is pressed by the arm 15 as described above, first of all, the outer thin pad 25*a* of the second protrusion 25 is deformed, bringing the ring-shaped unit 28 into contact with the insulating substrate 4. Then, the inner thin pad 25*b* is deformed. At that time, a click feeling is produced and transmitted to the operator through the driving body 2 and the operation body 3. Then, as the second protrusion 25 is inclined, the movable contact point 29 provided on the inner bottom surface of the second protrusion 25 is brought into contact with the fixed contact point 21 exposed to the movable contact point 29, causing the tilt detecting switch device associated with the second protrusion 25 to turn on. Since the movable contact point 29 is exposed to the external side of the elastic substrate 5 as described earlier and the second protrusion 25 is inclined away from the insulating substrate 4, the movable contact point 29 is brought into parallel contact with the fixed contact point 21**.

As the force inclining the operation body 3 is removed, the inclined operation body 2 and the slippery ring 6 are raised to positions shown in FIG. 1 by virtue of the elastic property of the second protrusion 25 itself. As a result, the movable contact point 29 is separated away from the fixed contact point 21, restoring the tilt detecting switch device to its original off state. It should be noted that, when the operator inclines the operation body 3 by pressing another peripheral of the operation body 3, one or two of the second protrusions 25 located in the inclining direction operate in the same way as the one described above, turning on the tilt detecting switch devices associated with the affected second protrusions 25.

Figure 8:
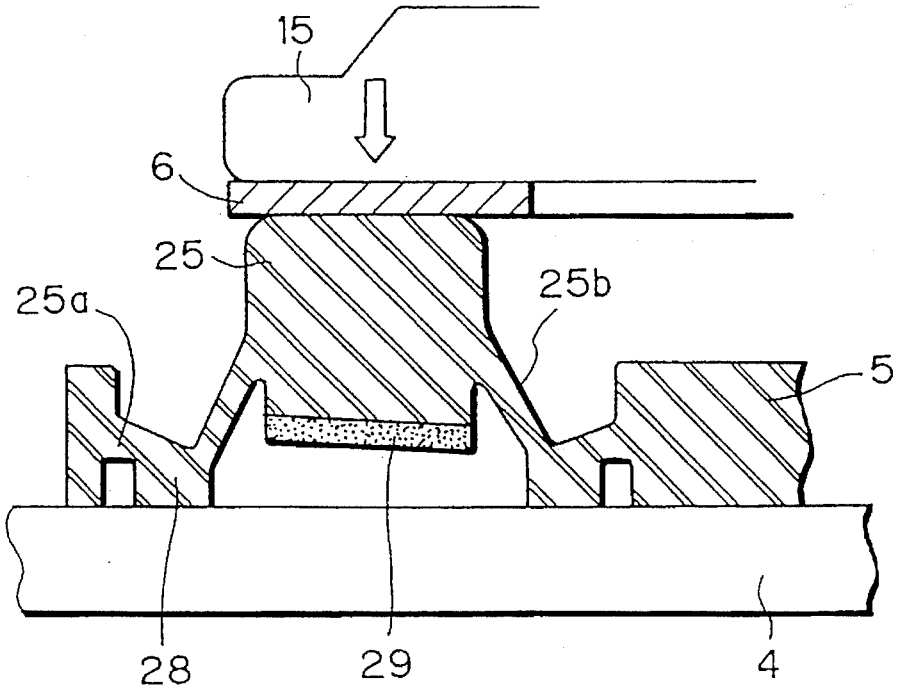
FIG. 8 is an explanatory diagram used for explaining the pressing operation of a second protrusion provided in the multidirection input apparatus.

Furthermore, with the multidirection input apparatus put in an inoperative state shown in FIG. 1, let the operator press the center of the operation body 3. At that time, the operation body 3, the driving body 2 and the slippery ring 6 move downward, resisting the elastic forces of all the second protrusions 25. At the same time, the pressing unit 14 of the driving body 2 puts a pressure on the stem of the tact switch 20, turning on the tact switch 20 from which a click feeling is transmitted to the operator through the driving body 2 and the operation body 3. At that time, the second protrusions 25 each experience a pressing force applied by the driving body 2, changing their shapes till the ring-shaped unit 28 is brought into contact with insulating substrate 4 as shown in FIG. 8. However, it is only the outer thin pads **25*a* that are deformed by the pressing force. The inner thin pads 25*b* which require a relatively large pressing force to change their shapes are not deformed. As a result, the attenuation of the click feeling by the second protrusions 25 which click feeling is produced by the tact switch 20** can be suppressed.

In the embodiment described above, when the driving body 2 is rotated by the operation body 3 in either the normal or reversed direction, the side surface of one of the first protrusions 26 provided on the elastic substrate 5 is pressed by one of the pressing units 16 of the driving body 2, deforming the thin pad **26*a* of the first protrusion 26. As a result, the first protrusion 26 is inclined toward the side opposite to the pressed side with pressed side serving as a fulcrum. Since the movable contact point 27 provided on the inner bottom surface of the first protrusion 26 is located at an eccentric position relative to the center of the first protrusion 26, the movable contact point 27 is brought into contact with the fixed contact point 22 on the insulating substrate 4 even if the first protrusion 26 is inclined only slightly, causing the rotation detecting switch device to turn on. In addition, even after the movable contact point 27 has been brought into contact with the fixed contact point 22, an overstroke is obtained due to the elastic deformation of the first protrusion 26**, allowing the operation feeling to be enhanced.

In addition, when the driving body 2 is inclined in an arbitrary direction by pressing an arbitrary peripheral of the operation body 3, the ceiling surface of one of the second protrusions 25 placed in the inclining direction is pressed by one of the arms 15 of the driving body 2. At that time, the movable contact point 29 provided on the inner bottom surface of the second protrusion 25 is brought into contact with the fixed contact point 21 provided on the insulating substrate 4, causing the tilt detecting switch device to turn on. Accordingly, the movable contact points 27 and 29 of the rotation and tilt detecting switch devices can all be formed into a single assembly in conjunction with the first and second protrusions 26 and 25 of the elastic substrate 5. As a result, the insulating substrate 4 and the elastic substrate 5 mounted above the insulating substrate 4 are the only components constituting the contact mechanisms of the rotation and tilt detecting switch devices, not only resulting in a reduced component count and fewer assembly operations but also preventing the height of the multidirection input apparatus from being increased due to the fact that it is no longer necessary to employ a horizontal-type tact switch as a switch device for detecting a rotation.

On the top of that, the slippery ring 6 is installed between the lower surfaces of the arms 15 of the driving body 2 and the ceiling surfaces of the second protrusions 25 of the elastic substrate 5, and the cuts **6*a* are formed on the slippery ring 6, for holding the two first protrusions 26 of the elastic substrate 5. Accordingly, when the driving body 2 is rotated by the operation body 3, the slippery ring 6 does not rotate over the elastic substrate 5. Instead, the lower surfaces of the arms 15 of the driving body 2 rotate as well as slide over the upper surface of the slippery ring 6. As a result, the second protrusions 25 do not get worn off due to the rotation of driving body 2**, allowing the lives of the contact mechanisms to be lengthened.

An embodiment implementing a multidirection input apparatus, wherein a variety of contact points can be switched in accordance with operations to rotate, incline and push the operation body 3, has been explained. It should be noted, however, that the present invention can also be applied to a multidirection input apparatus wherein only the operations to rotate and incline the operation body 3 can be carried out, eliminating the operation to push the operation body 3. In addition, the present invention can also be applied to a multidirection input apparatus wherein only the operation to rotate the operation body 3 in order to switch the contact points can be carried out, eliminating the operations to push and incline the operation body 3.

In addition, the second protrusions 25 of the elastic substrate 5 each have a ring-shaped unit 28 extending upward above the insulating substrate 4 through the outer thin pad **25*a*, and the inner thin pad 25*b* extending from the ring-shaped unit 28 in a slanting/upward direction. As a result, when the operator presses the center of the operation body 3, experiencing a pressing force applied by the driving body 2, the second protrusions 25 each also change the shape thereof till the ring-shaped unit 28 is brought into contact with insulating substrate 4. At that time, however, it is only the outer thin pads 25*a* that are deformed by the pressing force. The inner thin pads 25*b* which require a relatively large pressing force to change their shapes are not deformed. As a result, the amount of click feeling produced by the tact switch 20 is all but hardly reduced by the second protrusions 25**, allowing the operation feeling to be enhanced by virtue of the unaffected click feeling.

In addition, a tact switch 20 is employed in the embodiment described above as a switch device for detecting a vertical movement. It should be noted, however, that a switch of the click-rubber type having the same configuration as the second protrusions 25 can also be employed as a substitute for the tact switch 20.

As described above, according to the present invention, a contact-point switching mechanism with an overstroke can be implemented without employing a horizontal-type tact switch by inclining a protrusion provided on an elastic substrate by means of a driving body, allowing the operation feeling to be enhanced.

In addition, according to a multidirection input apparatus provided by the present invention, movable contact points of rotation and tilt detecting switch devices can be provided on the elastic substrate mounted above an insulating substrate. As a result the number of components and the number of assembly operations can be reduced, allowing the thickness of the multidirection input apparatus to be decreased.

In addition, according to the present invention, when a switch device for detecting a vertical movement is actuated by putting a pressure on the center of the driving body, outer thin pads of protrusions on the elastic substrate for holding the driving body each merely change its shape till a middle portion thereof is brought into contact with the insulating substrate. Since inner thin pads which each require a relatively large pressing force are not deformed, the amount of click feeling produced by the switch device for detecting a vertical movement is all but hardly weakened by the switch device for detecting a tilt. As a result, a multidirection input apparatus that offers clear click feeling and good operation feeling can be implemented.

What is claimed is:

1. A rotary operation switch comprising: a driving body held in a housing in such a way that said driving unit can be rotated; a switch device embedded in said housing; and an insulating substrate used for mounting said switching device, whereby said switching device is actuated by rotating said driving body, a fixed contact point for said switching device being provided on said insulating substrate, a movable contact point for said switching device being provided on a lower surface of an elastic substrate mounted above said insulating substrate, a protrusion being provided on an upper surface of said elastic substrate, protruding into a rotation area of said driving body, and said movable contact point being placed at an eccentric position relative to a center of said protrusion.

2. A multidirection input apparatus comprising: a driving body held in a housing in such a way that said driving body can be rotated and tilted in a number of directions; a switch device for detecting a rotation and a plurality of switch devices each for detecting a tilt which switch devices are embedded in said housing; and an insulating substrate for mounting said switch devices, whereby said switch device for detecting a rotation is actuated by rotating said driving body and said switch devices each for detecting a tilt are selectively actuated by tilting said driving body in any arbitrary direction, a fixed contact point for each of said switch devices for detecting a rotation and said switch devices each for detecting a tilt being provided on said insulating substrate, an elastic substrate having a first protrusion and a set of protrusions being mounted above said insulating substrate, said first protrusion protruding into a rotation area of said driving body, a movable contact point of said switch device for detecting a rotation being provided on an inner bottom surface of said first protrusion at an eccentric position relative to a center thereof, said set of protrusions being exposed to a lower surface of said driving body, and movable contact points for said switch devices each for detecting a tilt being each provided on an inner bottom surface of any one of said set of protrusions.

3. A multidirection input apparatus according to claim 2, wherein a slippery ring is provided between said elastic substrate and said driving body, said slippery ring is mounted on ceiling surfaces of said set of protrusions and a cut for inserting said first protrusion is formed on said slippery ring.

4. A multidirection input apparatus comprising: a switch device for detecting a vertical movement and a plurality of switch devices each for detecting a tilt; an insulating substrate for mounting said switch devices; and a driving body held by said switch devices each for detecting a tilt in such a way that said driving body can be moved up and down as well as tilted, whereby said switch device for detecting a vertical movement is actuated, providing a click feeling to the operator when the operator puts a pressure on a center of said driving body, and said switch devices each for detecting a tilt are selectively actuated by tilting said driving body in any arbitrary direction, a fixed contact point for each of said switch devices for detecting a tilt being provided on said insulating substrate, an elastic substrate being mounted above said insulating substrate, a middle portion extended above said insulating substrate through an outer thin pad being provided on said elastic substrate, a plurality of protrusions each protruding from said middle portion in a slanting upward direction through an inner thin pad being provided on said elastic substrate, and a movable contact point for each of said switch devices for detecting a rotation being provided on an inner bottom surface of any one of said protrusions.

* * * * *